United States Patent [19]

Hautemont

[11] Patent Number: 4,565,052

[45] Date of Patent: Jan. 21, 1986

[54] PROCESS AND INSTALLATION FOR PACKAGING A PRODUCT

[75] Inventor: Jean-Claude Hautemont, Gif-sur-Yvette, France

[73] Assignee: Societe a Responsabilite Limitee dite, Les Ulis, France

[21] Appl. No.: 502,013

[22] Filed: Jun. 7, 1983

[30] Foreign Application Priority Data

Jun. 14, 1982 [FR] France ..... 82 10353

[51] Int. Cl.[4] ..... B65B 3/02; B65B 3/06

[52] U.S. Cl. ..... 53/453; 53/559; 53/300

[58] Field of Search ..... 53/453, 559, 329, 300, 53/373, 478

[56] References Cited

U.S. PATENT DOCUMENTS

| | | | |
|---|---|---|---|
| 3,267,639 | 8/1966 | Ollier et al. | 53/559 X |
| 3,673,760 | 7/1972 | Canamero et al. | 53/559 X |
| 3,942,299 | 3/1976 | Bory | 53/453 X |
| 4,012,888 | 3/1977 | Nichols | 53/559 X |

FOREIGN PATENT DOCUMENTS

| | | |
|---|---|---|
| 1533462 | 6/1968 | France . |
| 2028763 | 10/1970 | France . |
| 2133171 | 10/1972 | France . |

*Primary Examiner*—Horace M. Culver

*Attorney, Agent, or Firm*—Scully, Scott, Murphy & Presser

[57] ABSTRACT

The invention relates to a process for packaging a product, particularly a liquid or pasty product, comprising thermoforming, filling, sealing and cutting out recipients of thermoplastics material, in which the path of advance of the recipients in the forming and sealing stations is cleared by lowering the mobile part of the moulding unit and that of the lower sealing support; a lower cutting tool is used in the cut-out station, comprising a fixed longitudinal part and a mobile transverse part which is lowered to clear the path of advance the recipients; sections of supporting and guiding rail are used both in the sealing and cut-out stations and at the outlet of the cut-out station. In the sealing station, the corresponding sections of rail are used as fixed parts of sealing support, and, in the cut-out station, the corresponding sections of rail are used for longitudinally cutting out the recipients and for supporting and longitudinally guiding the latter.

13 Claims, 17 Drawing Figures

III
IV
V
VI
VII
VIII
1
2
3
4
5
5a
5b
5c
5d
6
7
8
9
10
11
12
13
14
15
16
17
18
19
20
21
22
24
25
26
26a
26b
33
33-40
34
35
37
38
39a
39b
40b
60
61
63
65
97
98

1
7
8
13
14
15
16
22
23
26a
26b
27
28
29
31
32
33
40b
54
56
65

PROCESS AND INSTALLATION FOR PACKAGING A PRODUCT

BACKGROUND OF THE INVENTION

The present invention relates to a process for packaging a product comprising the operations of thermoforming, filling and sealing of recipients of thermoplastics material.

According to a known process for packaging, known in particular by French Pat. No. 1,512,671, a thermoplastics web is unwound from a roller and is advanced step by step, being held on its two edges parallel to its direction of advance, said web is heated, in successive zones, up to its softening temperature and, during each of the successive steps of said web, at least one transverse row of recipients is thermoformed in a forming station in at least one row of forming chambers of a moulding unit in two parts, of which one, the front part, is mobile with respect to the other, so-called rear part. According to this known process, the recipients of at least one row of recipients are simultaneously filled with a product, particularly a liquid or pasty product, the openings of the filled recipients are covered with a covering web which is deposited on the thermoplastics web provided with the thermoformed recipients, said covering web is sealed on the edges of said recipients which are still attached to the thermoplastics web, in a sealing station comprising a lower sealing support of which one part is fixed and another part is mobile. Finally, in a cut-out station, the filled and sealed recipients are detached, in groups or individually, from the thermoplastics web and the covering web which are sealed to each other, and the sealed and cut out recipients are then evacuated, the edges of the recipients and the corresponding zones of the thermoplastics web being supported between the different work stations by supporting and guiding rails extending in the direction of advance of the thermoplastics web and said recipients.

The present invention also relates to an installation for packaging, of the type known by French Pat. No. 1 512 671. This packaging installation comprises a station for unwinding a thermoplastics web, also referred to as web forming the recipients, a station for heating the thermoplastics web, a thermoforming station for simultaneously making in said thermoplastics web at least one transverse row of recipients of which the openings are directed upwardly and comprising a moulding unit which presents a transverse row of forming chambers and is provided with a fixed rear part installed immediately beneath the path of the thermoplastics web and with a mobile part adapted to move away from the path of advance of the recipients. This packaging installation further comprises a station for filling the recipients with a product, particularly a liquid or pasty product, a station for unwinding a covering web, a station for sealing the covering web on the web forming the recipients on the edges of said recipients, this station presenting an upper sealing head and a lower sealing support comprising at least one mobile part so as to be able to move away from the path of advance of the recipients. The packaging installation also comprises a cut-out station comprising an upper cut-out tool provided with mobile upper blades and a lower cut-out tool provided with lower blades, and longitudinal supporting and guiding rails extending in the direction of advance of the thermoplastics web and said recipients as well as means for advancing the thermoplastics web, the recipients and the covering web step by step and means for controlling the different members for heating the thermoplastics web and forming, filling, sealing and cutting out said recipients.

According to the known prior art, the mobile parts of the moulding unit constituted by transverse partitions are withdrawn from the path of the thermoformed recipients in a horizontal transverse direction so that these transverse partitions emerge laterally from the packaging installation and in particular from the horizontal projection of the thermoplastics web forming recipients. Consequently, it is impossible to provide clips or gripping elements adapted to grip on the longitudinal edges of the thermoplastics web and fast with longitudinal endless chains for conveying said thermoplastics web with its recipients through the different work stations of the installation. According to the known state of the art, pairs of conveyor rollers pulling on the thermoplastics web and the covering web sealed thereon have therefore been provided downstream of the cut-out station. It will be readily understood that, to ensure transport of the thermoplastics web with the filled and sealed recipients through the whole installation, considerable efforts must be exerted on said thermoplastics web which very frequently deforms in uncontrollable fashion under the influence of these efforts and under the effect of the contraction of the thermoplastics web. To ensure traction on the webs in this way, there must always be at least one grid of web after the recipients have been cut out, so that it is virtually impossible to effect for the recipients a cut-out without at least longitudinal scrap.

Another drawback of the state of the art resides in the fact that both the lateral parts and the front and rear parts of the recipients must be flat and they join along sharp angles. In addition, the rear part or the front part of these recipients cannot be provided with vertical grooves.

The same drawbacks are due to the particular design of the lower sealing support of which the mobile parts can move only horizontally and transversely to the direction of advance of the recipients.

In the known cut-out station, the lower cutting tool is constituted by a plurality of dies which cooperate with corresponding punches of the upper cutting tool. Taking into account the particular structure of the lower cutting tool, the recipients cannot be detached in groups but only individually and, in addition, the recipients cut out individually must descend through the corresponding die over the whole height thereof before being able to be taken by a conveyor belt. As soon as the recipients have been cut out, they are therefore no longer guided and can no longer be manipulated with precision. Furthermore, it so happens that the individual recipients frequently jam in the vertically mobile dies of the lower cutting tool and provoke stoppages of the installation.

It has also been ascertained that the considerable stroke of the lower cutting tool leads to repeated acceleration and deceleration of the very considerable masses, with the result that the working speed of the whole of the installation is relatively low and large supporting structures must be provided, particularly at the location of the die of the lower cutting tool to absorb the different outstanding efforts without deformation.

A moulding unit is also known (cf. French Pat. Nos. 2 256 818 and 2 439 712) presenting two parts of which the rear part is fixedly installed at the level corresponding to the position of thermoforming of the recipients, and of which the front part may be lowered from the thermoforming position, to clear the passage for the horizontal advance of the recipients which have just been thermoformed. According to this state of the art, the lowering of the mobile front part of the moulding unit serves, in the first place, for the introduction of a decorative element in the different forming chambers and its purpose for the whole installation is neither the reduction in the mobile pieces nor the simplification of the packaging process. In fact, the state of the art illustrated by the two French Patents last mentioned gives no precise indication as to the seal and cut-out of the recipients which are effected in conventional manner and therefore present the well-known drawbacks.

When the thermoformed recipients are of large dimensions, containing for example a volume of one liter, the lateral walls are deformed, forming bulges under the effect of the weight of the contents of the recipients. Taking into account the fairly low rigidity of the lateral walls of the recipients, it should be possible to make a low vacuum in the recipients in order to avoid their bulging outwardly which, with the known cut-out system incorporating punch and die, often leads to the recipients which are insufficiently engaged in the corresponding die, being crushed.

SUMMARY OF THE INVENTION

It is one of the objects of the present invention to eliminate the above-mentioned drawbacks.

It is a further object of the invention to improve the known process of the state of the art so as to enable the rate of production of recipients to be increased and to reduce as much as possible the number of mobile pieces particularly beneath the plane of path of the thermoplastics web. A further object of the invention is to propose means for thermoforming, filling, sealing and cutting out recipients presenting lateral faces having straight generatrices parallel to the direction of advance of the recipients and front and rear walls presenting straight generatrices which are either vertical or inclined downwardly and from the upper edge towards the axis of the recipients.

To attain these different objects, the process according to the invention is characterized in that the path of advance of the recipients in the forming and sealing stations is cleared by lowering the mobile parts of the moulding unit and of the lower sealing support, in that a lower cutting tool is used in the cut-out station, comprising a fixed longitudinal part and a mobile transverse part which is lowered to clear the path of the recipients, in that sections of supporting and guiding rail are used both in the sealing and cut-out stations and at the outlet of the cut-out station, in that, in the sealing station, the corresponding sections of rail are used as fixed parts of the lower sealing support, in that, in the cut-out station, the corresponding sections of rail are used for longitudinally cutting out the recipients and for supporting and longitudinally guiding the latter.

The installation according to the invention is characterized in that the front part of the moulding unit is mounted to move perpendicularly to the plane of advance of the thermoplastics web, over a height at least equal to that of the thermoformed recipients, the mobile part of the lower sealing support is mounted to move perpendicularly to said plane of advance over at least the whole height of said recipient, the lower cutting tool of the cut-out station comprises a fixed longitudinal part and a transverse part mobile perpendicularly to the plane of advance of said thermoplastics web over at least the whole height of the recipients, the fixed part of the lower cutting tool is constituted by sections of supporting and guiding rail and all the fixed parts located beneath the path, i.e. the plane of advance of the thermoplastics web, are mounted on a common structure which extends at least from the forming station to the cut-out station inclusive.

Due to these measures, firstly, the recipients are guided laterally not only in all the work stations from the thermoforming station, but also between the different work stations; secondly, not only are the different recipient forming, sealing and cut-out operations considerably simplified, but also the number of mobile pieces particularly beneath the path of the thermoplastics web is considerably reduced, whilst ensuring guiding and perfect support both of the thermoplastics web and of the recipients which are formed therein and, thirdly, any crushing of the recipients during the sealing and cut-out operations is thus rendered virtually impossible.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENTS

Figure 1:
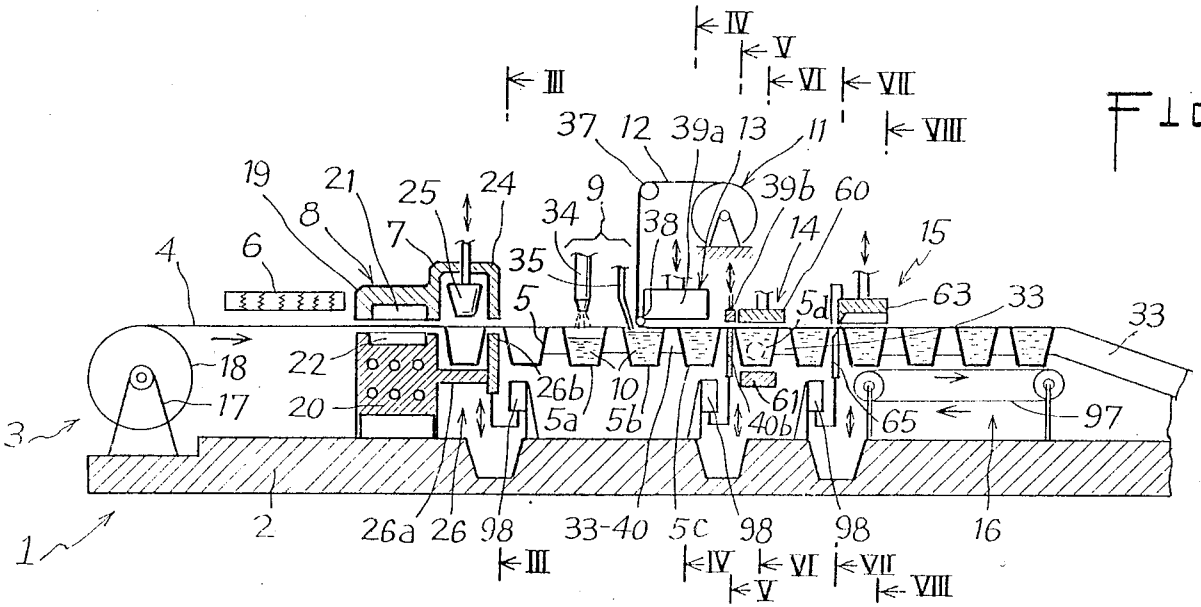
FIG. 1 is a schematic view of a vertical longitudinal section through the packaging installation.
Figure 2:
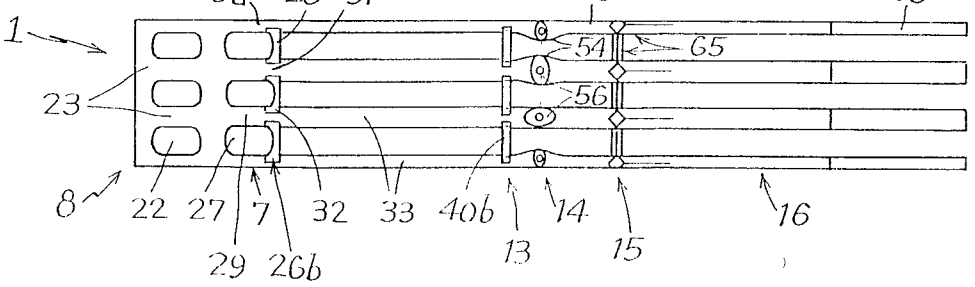
FIG. 2 is a plan view of that part of the installation located beneath the plane of advance of the thermoplastics web from the thermoforming station.
Figure 5:
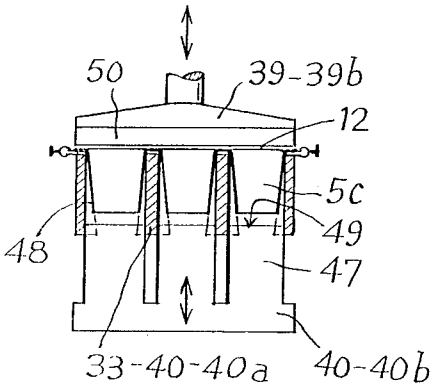
FIGS. 3 to 8 are views in elevation of vertical transverse sections along lines III—III, IV—IV, V—V, VI—VI, VII—VII and VIII—VIII, these sections being made respectively at the outlet of the thermoforming station, in the sealing station, at the outlet of the sealing station, in the lateral compression station and in the cut-out station, on the one hand, near its inlet and, on the other hand, near its outlet.
Figure 8:
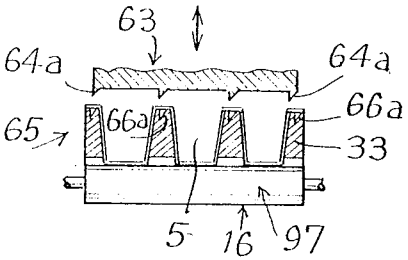

Referring now to the drawings, FIGS. 1 and 2 show the packaging installation 1 which comprises, successively, on a common supporting structure such as a frame 2: a station 3 for unwinding a thermoplastics web 4, referred to as recipient-forming web and from which will be formed thermoplastics recipients 5; a heating station 6 to take the thermoplastics web to its softening temperature appropriate for subsequent thermoforming; a thermoforming station 7 possibly preceded by a cooling grid 8; a filling station 9 in which the recipients 5 which have just been formed in the thermoplastics web 4 are filled with a product 10, in particular a liquid or pasty product; a station 11 for unwinding a covering web 12 adapted to cover the openings of the recipients 5 and to be hermetically sealed on the thermoplastics web 4 at the location of the edges surrounding the openings of said recipients 5; a station 13 for sealing the covering web 12 on the recipient-forming web 4 at the edges of said recipients 5; possibly a lateral compression station 14; a cut-out station 15 and an evacuation station 16. The packaging installation 1 also comprises means for driving the thermoplastics web 4 and the covering web 12 step by step, such as endless chains provided with gripping elements and sequential control means for forming, filling, sealing and cutting out the recipients 5.

In the unwinding station 3 are provided a support 17 mounted on the frame 2 and a bobbin 18 borne by said support 17 and from which control means (not shown) unwind, according to need, the thermoplastics web 4 of which the path or plane of advance may be slightly inclined with respect to the horizontal from upstream to downstream and downwardly for reasons which will be explained hereinafter. The heating station 6 is of known design and therefore does not need to be described in greater detail here. The cooling grid 8 comprises an upper plate 19 disposed above the plane of advance of the thermoplastics web 4 as well as a lower cooling unit 20 disposed beneath said plane of advance. Said plate 19 and unit 20 comprise in their flat faces adjacent the plane of advance of the web 4 a transverse row of recesses 21, 22 extending respectively upwardly and downwardly and leaving therebetween a network of cooling zones 23 which define those parts of web from which the lateral walls and the bottoms of the recipients 4 will be formed. In other words, when the softened thermoplastics web is applied by the plate 19 vertically mobile against the cooling unit 20 which is immobile, this web 4 is locally cooled and rigidified depending on the shape of the predetermined network 23.

In the immediate vicinity and downstream of the cooling grid 8 is provided the thermoforming station 7 which presents, on the one hand, above the plane of advance of the thermoplastics web 4, a vertically mobile forming bell 24 in which are mounted, in a transverse row, a plurality of forming punches 25 likewise vertically mobile and, on the other hand, beneath said plane of advance, a moulding unit 26 which presents a transverse row of forming chambers 27. This moulding unit 26 is provided, on the one hand, with a fixed rear part 26*a* installed immediately beneath the plane or path of advance of the thermoplastics web 4 and, if necessary, is fast with the cooling unit 20 which it follows or is integrated therein, and, on the other hand, a front part 26*b* which is mounted mobile vertically, i.e. perpendicularly to the plane of advance of the thermoplastics web 4 over a height at least equal to that of the thermoplastics recipients 5. The openings of the forming chamber 27 are preferably elongated in form and are inscribed in rectangles of which one pair of parallel sides, preferably the one having the longer sides, is parallel to the direction of advance of the thermoplastics web 4. In general, the bottom of each forming chamber 27 presents a transverse section identical or similar to that of its upper opening and preferably covers an area at least slightly smaller than that of said opening. In this way, recipients are obtained with lateral walls which are vertical or slightly inclined with respect to the vertical and being more or less close to one another towards the bottom. The rear and front walls of chambers 27 and of recipients 5 may be more or less curved both in a horizontal plane and in a vertical plane provided, for the latter case, that the descending movement of stripping of the mobile front part 26*b* is not hindered by the special curved configuration of the front wall of the recipients 5.

The mobile front part 26*b* of the moulding unit 26 comprises a plurality of vertical partitions 28 in a number identical to that of the forming chambers 27 and of which the rear face is shaped so as to join, without noteworthy set-back, to the front end of the longitudinal lateral walls 29 of the corresponding forming chamber part and incorporated in the fixed part 26*a* of the moulding unit 26. The lower ends of these vertical partitions 28 are mounted on a transverse supporting bar 30 and the assembly composed of partitions 28 and bar 30 may be displaced vertically between, on the one hand, a high position in which said partitions 28 complete the rear fixed part 26*a* of the moulding unit 26 to define the forming chambers 27 and, on the other hand, a low position in which said partitions 28 entirely clear the path of advance of the recipients parallel to that of the thermoplastics web 4 so that the recipients 5 which have just been formed may leave their forming chambers 27 without obstacle.

The longitudinal lateral walls 29 separating two adjacent forming chambers 27 of the same transverse row of forming chambers and provided in the fixed part 26*a* of the moulding unit are extended forwardly, i.e. in the direction of the filling station 9, by sections of supporting and guiding rail 31. The front partitions 28 are disposed so as to be able to move on either side of these sections of rail 31 and are guided laterally in guides 32 provided in the lateral walls 29 of the forming chambers 27 and/or in their extensions constituted by the sections of supporting and guiding rail 31.

To the sections of rail 31 are connected, without set-back with respect to the faces of the longitudinal lateral walls 29, longitudinal supporting and guiding rails 33 which extend parallel to the plane of advance of the web 4 through all the following parts of the installation 12 and which, as will be seen hereinafter, perform in certain of the work stations functions other than those of guiding and supporting. As the thermoplastics web 4 undergoes, after its softening followed by a cooling in a cooling grid 8 and in the thermoforming station 7, a certain transverse shrinkage, the supporting and guiding rails 33 may be disposed so as to be slightly convergent from the outlet of the thermoforming station towards the sealing station 13, this with respect to the longitudinal median vertical plane of the installation 1. The supporting and guiding rails 33 abut on the frame 2 and serve firstly to support the recipients 5, particularly when they are filled and to avoid the lateral walls of said recipients which pass between two adjacent rails being substantially deformed under the effect of the weight of the filling product. For this reason, the height of the rails 33 is at least equal to that of the recipients 5 whenever this proves advantageous.

The filling station 9 is associated with at least two transverse rows of recipients 5*a*, 5*b* and comprises two distinct filling units 34, 35 of which each comprises a row of filling nozzles connected via a distributor to a tank of liquid or pasty product. The filling nozzles of the first filling unit 34 are associated with and disposed above a first row of recipients 5*a* and serve to fill recipients of this row 5*a* roughly and quickly, i.e. at high speed, and the filling nozzles of the second filling unit 35 are associated with a second row of recipients 5*b* of which the recipients have just been roughly filled. These nozzles of the second filling unit 35 serve for complementary, precise filling, preferably at low speed, of the recipients 5*b* which were roughly filled beforehand and are disposed upstream and in the immediate vicinity of the sealing station 13 above a rear part of a recipient of the second row of recipients 5*b* already roughly filled and already partially engaged in said sealing station 13. This design of the filling station 9 is particularly advantageous when the supporting and guiding rails 33 are slightly inclined with respect to the horizontal, downwardly and forwardly of the installation at least at the filling and sealing stations and preferably over the whole length of the installation 1, this inclination preferably not exceeding a slope of 30° with respect to the horizontal. It will be noted, particularly in FIG. 9, that the inclination of the openings of the recipients with respect to the horizontal makes sense only in the case of the opening of the already partially filled recipient 5*b* being provided on its greater lower or downstream part with the covering web 12 which is sealed, at least on its longitudinal edges, on the edges or corresponding parts of the thermoplastics web 4. In fact, this arrangement conserves solely a small opening 42 for the complementary filling of the recipients 5*b* and makes it possible to cause the product to rise in these recipients 5*b* virturally up to the upper end of the sealing zone 36 in which the covering web 12 is hermetically fixed on the recipient-forming web 4. In other words, this arrangement makes it possible to raise the level of the product above the downstream lower part of the edge of the recipients 5*b* partially engaged in the upstream part of the sealing station 13. It will be readily understood that this modus operandi makes it possible considerably to reduce the volume of residual air enclosed in the filled and sealed recipients. This advantage will be fully appreciated when it is known that the volume of residual air generally remaining in the recipients after thay have been filled conventionally and sealed corresponds to a diffusion of oxygen of 6 weeks to 2 months through the thermoplastics wall of the recipient. In other words, the normally filled and sealed thermoplastics recipients are already 6 weeks old as far as their oxygen content is concerned.

Figure 4:
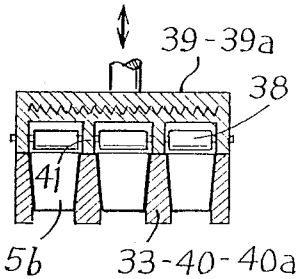
Figure 7:
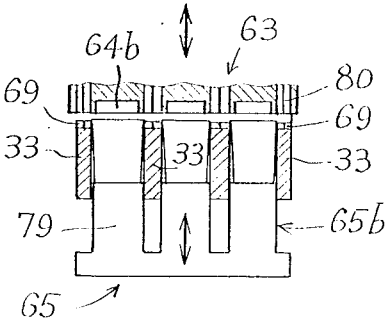
Figure 3:
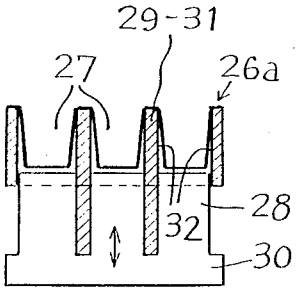
Figure 6:
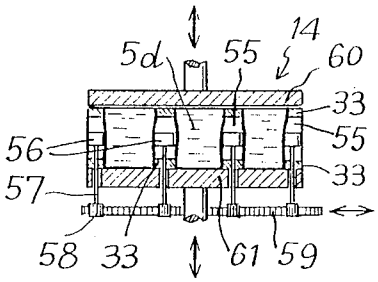
Figure 9:
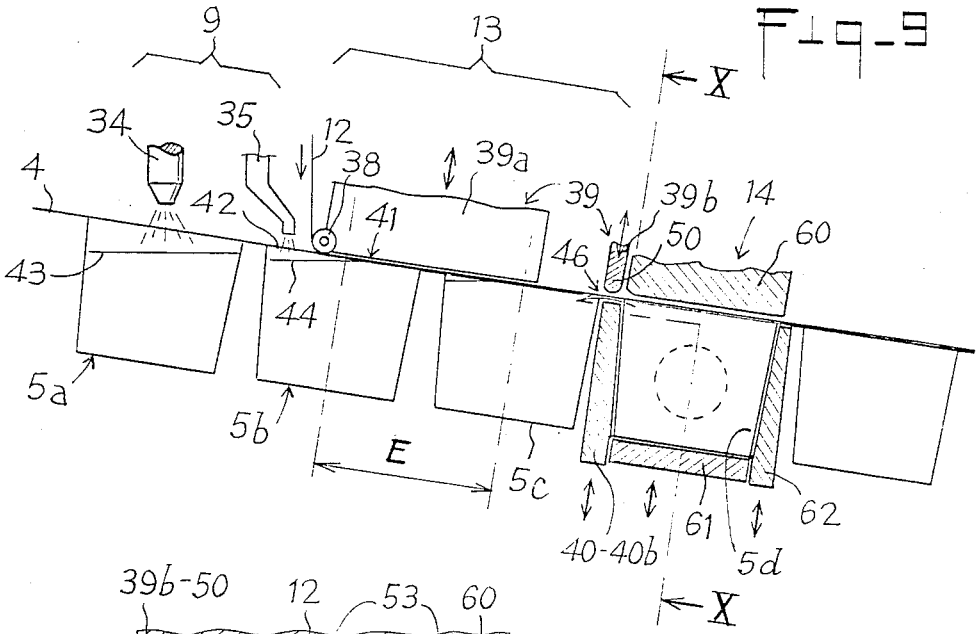
FIG. 9 is a view in elevation of a vertical longitudinal section through a part of the installation, part comprising the filling station, the sealing station and the lateral compression station.
Figure 10:
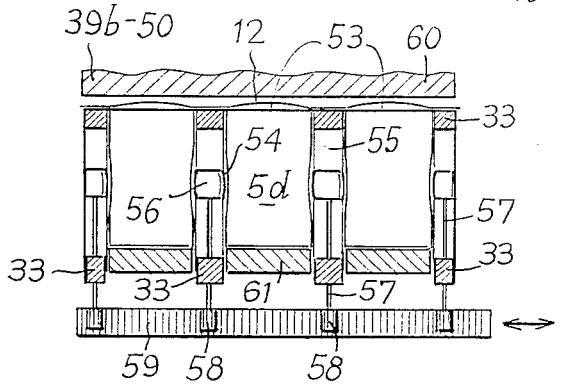
FIG. 10 is a view in elevation of a transverse section along broken line X—X of FIG. 9, passing through the lower part of the lateral compression station and then in front of the outlet of the upper part of the sealing station.
Figure 11:
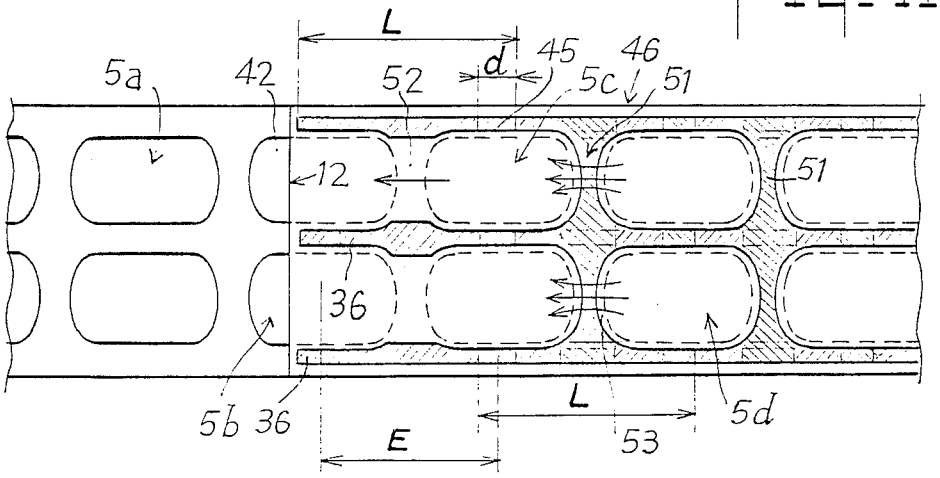
FIG. 11 is a plan view of FIG. 9, the elements of the different stations located above the plane of advance of the thermoplastics web having been removed in order to render the drawings clearer.

As may be seen in FIGS. 1, 4 and 9, the covering web 12 is conducted to the recipient-forming web 4 with the aid of a plurality of guide rollers 37, 38 of which the lower roller 38 is located very close to the upstream end of the sealing station 13 or is integrated therein. This sealing station 13 comprises, on the one hand, an upper sealing head 39 disposed above the path of advance of the thermoplastics web 4 and adapted to move over a short distance, perpendicularly to said path of advance, and, on the other hand, a lower sealing support 40 disposed beneath said path of advance. The sealing station 13 and its members 39, 40 are disposed so as to cover a zone whose width is that of the covering web 12 and whose length is greater than the distance between axes E of two successive recipients of the same row of recipients taken in the direction of advance of the recipients 5, 5*a*, 5*b* but shorter than the length of two successive recipients, the distance between axes E being equal to the length of an advance step of said recipients. The sealing head 39 essentially comprises a longitudinal sealing head 39*a* which extends parallel to the direction of advance of the recipients 5, 5*a*, 5*b* and comprises longitudinal sealing ribs 41 disposed above the supporting and guiding rails 33 of which the sections positioned at the longitudinal sealing head 39*a* constitute the fixed part 40*a* of the lower sealing support 40. The upstream end of the longitudinal sealing head 39*a* bears the guide roller 38 or an equivalent element such as a cylindrical plate for guiding the covering web 12 and is disposed above the upstream half of the recipient 5*b*, associated with the complementary filling unit 35. In this way, when the covering web 12 is longitudinally sealed on the corresponding recipient 5*b*, there remains only a small opening 42 for filling of which the section of passage is substantially reduced with respect to that of the normal opening of the recipient. After advance by one step of the recipient 5*a* roughly filled up to level 43 located beneath the lower downstream edge of the normal opening of the recipient 5*a*, the recipient now designated by reference 5*b* may be filled up to a level 44 which is substantially above the lower downstream edge of the normal opening of the recipient 5*b* which, as may be seen in FIG. 9, is inclined with respect to the horizontal. The downstream end of the longitudinal sealing head 39*a* is located above the downstream half of a recipient 5*c* belonging to the row of recipients preceding the one comprising the recipients 5*b* subjected to complementary filling. The length of the longitudinal sealing head 39*a* is at least slightly greater than the distance between axes E of two successive recipients 5*b*, 5*c* of the same row of recipients and the arrangement of this longitudinal sealing head 39*a* is such that it overlaps two successive rows of recipients (5*b*, 5*c*) and preferably such that the opening 42 of the recipients 5*b* partially covered by the covering web 12 and sealed, presents a minimum area. The longitudinal sealing head 39*a* therefore produces in cooperation with the corresponding sections of rail 33, 40, 40*a*, the longitudinal sealing zones 36 of which the length L is at least slightly greater than E (distance between axes of two successive recipients 5*a*, 5*b* or 5*b*, 5*c* of the same row of recipients) so that the ends of these longitudinal zones 36 overlap over a relatively short distance d where the overlap zone 45 is formed by a double sealing.

The sealing head 39 also comprises a transverse sealing member such as a transverse sealing bar 39*b* which is mobile perpendicularly to the thermoplastics web 4 and is disposed downstream of the longitudinal sealing head 39*a* above the zone of join 46 between the downstream row of recipients 5*c* associated with the downstream part of the sealing station 13 and the immediately preceding row of recipients 5*d* located at the outlet of said sealing station 13. The transverse sealing bar 39*b* may be fast with the same supporting plate as the longitudinal sealing head 39*a* and comprise, if necessary, heating and/or pressure means with an adjustment of power different from that of the heating and/or pressure means associated with the longitudinal sealing head 39*a*. This arrangement makes it possible to adapt the heating and/or pressure powers for longitudinal sealing and transverse sealing to the special conditions of sealing which, when certain parts of the edge of the recipients are likely to be wetted by the filling product, may be different from those concerning the sealing of dry surfaces.

It should be noted that the supporting and guiding rails 33 are not interrupted beneath the transverse sealing bar 39*b* and serve, as mentioned previously, as the fixed lower sealing support part 40*a*.

The lower sealing support 40 also comprises a mobile part 40*b* which, in the present case, is mobile perpendicularly to the plane of advance of the thermoplastics web 4 and comprises a supporting comb of which the vertical teeth 47, seen in front view, are rectangular in form and are guided laterally in vertical guides 48 arranged in the supporting and guiding rails 33 beneath the transverse sealing bar 39*b*. The supporting comb 40*b* whose teeth 47 serve, by their upper end face 49, as counterbearing for the continuous sealing rib 50 of the sealing bar 39*b*, may move in the guides 48 perpendicularly to the plane of advance of the thermoplastics web 4 over a height at least equal to that of the recipients 5. Of course, the configuration of the lower face of the sealing rib 50 of the sealing bar 39*b* and the upper end faces 49 of the teeth 47 of the lower mobile sealing support or supporting comb 40*b*, is adapted to the configuration of the edge parts of two adjacent recipients 5*c*, 5*d* of the same row of recipients. In this way, zones of transverse seal 51 may be obtained of which the curved contour is symmetrical with respect to the transverse vertical plane perpendicular to the longitudinal edges of the thermoplastics web 4.

From the foregoing, it results in that, for a recipient in question, partial longitudinal seals are firstly made in a first phase, then, after advance of said recipient by one step, complementary longitudinal seals and a transverse seal are effected, so that the covering web 12 is completely sealed on the longitudinal edges and on the front downstream transverse edge of the recipient in question, and, finally, after a further advance of the recipient by one step, the covering web 12 is sealed on the upstream rear transverse edge of the recipient in question and, at the same time, said covering web 12 is sealed on the downstream front transverse edge of the following recipient. It will be understood that the successive recipients of the same row of recipients 5*b*, 5*c*, 5*d* communicate with one another via the slots 52, 53 for passage existing between the common transverse edges of two successive recipients, for example 5*b* and 5*c* or 5*c* and 5*d*, and the covering web 12, these passages 52, 53 resembling horizontal slots and being eliminated by the transverse seal at the location of the transverse sealing bar 39*b*. These slots 52, 53 enable part of the product contained in the recipients 5*d* and 5*c*, particularly the air bubbles and other foam parts, to rise therethrough towards the adjacent recipient 5*c* or 5*b* upstream, possibly under the influence of forces of compression acting on the lateral walls of a recipient such as 5*d*. In fact, when the longitudinal lateral walls of a recipient 5*d* located immediately downstream of the sealing station 13 are pressed, a certain quantity of liquid or pasty product and/or air will be driven towards the upstream recipient 5*c* through the passage in the form of a slot 53 as long as the transverse seal of the covering web 12 has not been effected. Being given that the slot 53 is fairly thin, it may be used for breaking or bursting at least the large bubbles of air in the foam of product during transfer of a certain quantity of excess product from the downstream recipient 5*d* or 5*c* towards the upstream recipient 5*c* or 5*b*. It is only after having driven out all the air contained in the recipient 5*d* by the compression of its longitudinal lateral walls that its upper upstream edge is transversely sealed whilst the effort of compression is maintained, the downstream transverse edge of said recipient 5*d* having been sealed during the preceding transverse sealing operation. It follows from the foregoing that each recipient is firstly filled with a product of which the initial filling volume is slightly greater than the final volume of product packaged in the sealed recipient and that the inner volume of the recipient is then slightly reduced by compressing it laterally and delivering the quantity of product in excess with respect to the final volume of the packaged product, towards the adjacent recipient upstream before completely sealing the recipient whilst maintaining the lateral compression during the final sealing.

This lateral compression of the recipients 5*d* is effected in the lateral compression station 14 which is provided immediately upstream of the transverse sealing bar 39*b* and the mobile supporting comb 40*b*. This station 14 also comprises the supporting and guiding rails 33 of which the central part is recessed beneath the upper supporting faces and covered laterally, if necessary, by vertical plates 54 deformable in the transverse direction. In the central recesses 55 made in the sections of rails 33, sections corresponding to the lateral compression station 14, are mounted lateral compression means such as eccentrics 56 which are disposed between the upper edge and the bottom and preferably half way up the recipients and which, in a first position, retract in the recesses 55 in the supporting and guiding rails 33 and which, in a second position, project laterally from said recesses 55 and act either via the deformable plates 54 or directly, on the longitudinal lateral walls of the recipients 5*d*. The eccentrics 56 are keyed on vertical shafts 57 which are supported by bearings of the rails 33 and bear therebeneath pinions 58 cooperating with a control rack 59. The lateral compression station 14 may be used not only for driving out a certain quantity of air and/or of product from the recipients 5*d* towards the adjacent recipients upstream, but also to meter volumetrically, fairly precisely, the quantity of product contained in each recipient. To this end, there are associated with the lateral compression station 14, on the one hand, a flat upper plate 60 adapted to be maintained or applied under pressure against the covering web 12 already partially sealed on the edges of the recipients 5*d* and which covers almost all the opening of the or each recipient 5*d* engaged in the lateral compression station 14, with the exception of a zone located near the upper upstream edge of said recipient 5*d* near the slot 53 for passage where said plate 60 is bevelled, and, on the other hand, a bottom plate 61 which may be maintained against the bottom of the recipients 5*d*. It is also possible to provide rear and front plates of which the faces facing the recipients 5*d* are adapted to the shape of the rear and front walls of the recipients 5*d*. The rear plate is advantageously constituted by the supporting comb 40*b* and the front plate 62 is of design similar to said comb 40*b* and may also be lowered by a distance at least equal to the height of the recipients 5d and be guided vertically by guides provided in the rails 33. It results from the foregoing that the lateral compression of the recipients may be used for volumetrically metering the final quantity of the product packaged in each recipient by laterally compressing the recipient whilst preventing the deformation of its other deformable parts such as its cover 12 and its bottom and delivering the excess quantity of product under the effect of the lateral compression of the recipient through the slot 53 for passage and sealing said slot 53 whilst said lateral compression is maintained. The adjustment of the intensity of the lateral compression applied to the recipients 5d, i.e. the degree of projection with which the eccentric 56 laterally projects from the rails 33, may be effected as a function of the measured weight of a recipient or a group of recipients at the outlet of the installation, i.e. after said recipients have been cut out, this adjustment of the intensity of the lateral compression being undertaken with a view to adjusting the desired weight of a recipient.

Of course, for simplification purposes, lateral compression means may also be provided which are directly incorporated in the supporting and guiding rails 33 and constituted, for example, by a slight bulging of a central part of the lateral walls of said rails 33 at the lateral compression station 14, this bulge firstly progressively increasing up to a central point to maximum projection and then progressively decreasing to disappear in the flat lateral wall of the rails 33. It will be readily understood that the transverse sealing of the recipients is carried out when the recipients 5c, 5d are in the position indicated in FIGS. 1 and 9, whilst the lateral compression is maintained on the longitudinal lateral walls of the recipients 5d, said compression possibly only being slackened after the transverse sealing, with a view to facilitating advance of the recipients 5. To this same end, it is also advantageous to apply the lateral compression to the recipients 5d only after the end of an advance step of the recipients 5.

The cut-out station 15 provided after the sealing station 13 and, possibly, downstream of the lateral compression station 14—if this exists in the installation—comprises an upper cutting tool 63 provided with mobile upper blades 64 disposed above the path of advance of the thermoplastics web 4 and a lower cutting tool 65 provided with lower cutting blades 66 which cooperate with the upper blades 64. The lower cutting tool 65 comprises a fixed longitudinal part 65a and a transverse part 65b which is mobile perpendicularly to the plane of advance of the thermoplastics web 4 over at least the whole height of the recipients 5 so as to be able to be disengaged, by a descending movement, from the path of advance of said recipients 5. The longitudinal fixed part 65a of the lower cutting tool 65 is advantageously constituted by the sections of the guiding and supporting rails 33 positioned beneath the upper cutting tool and comprises longitudinal cutting blades 66a. From the upper supporting face 67 of the rails 33, each fixed lower cutting tool 65a comprises, from upstream to downstream, a notch 68, a punch 69 of which the upper face 70 is located in the same plane as the supporting face 67 of the rail 33 and forms with the lateral walls 71 of said punch 69 cutting edges 72 cooperating with the upper tool 63. The transverse section of this punch 69 is in the form of a diamond or in any appropriate shape and serves to cut the rounded, concave or oblique edge parts at the corners between at least two and, more generally, between four recipients grouped together. On the side opposite the notch 68 with respect to the punch 69 and at the same level as the bottom thereof, the rail 33 presents a horizontal flat upper face 73 interrupted by a longitudinal vertical face 74 which is in alignment with the downstream vertical edge 75 of the punch 69 and which forms with said horizontal face 73 a straight longitudinal cutting edge 76 and constitutes the longitudinal cutting blade 66a.

This vertical longitudinal face 74 constitutes one of the sides of a V-groove 77 of which the angle of opening is either acute or obtuse, with the result that the second side of this longitudinal straight groove 77 rises towards the horizontal flat face 73, or descends obliquely towards a lateral face 78 of the rail 33. The transverse part 65b of the lower cutting tool 65, part 65b vertically mobile between the rails 33, presents the form of a comb 79 with wide rectangular teeth of which the upper face bears transverse cutting blades 66b, for example, in relief and constituted by ribs of V cross section and of which the vertical faces cooperate with those of the transverse cutting blades 64b of the upper cutting tool 63. It should be noted that the vertical faces of the lower transverse blades 66b are aligned with the lateral vertical edges 75 of the punches 69. The longitudinal cutting blades 64a of the upper tool 63 cooperate with the longitudinal cutting blades 66a of the lower cutting tool 65, blades 66a materialized for example by the vertical longitudinal face 74 of the V-groove 77. The transverse mobile part 65b or cutting comb has an appropriate width enabling it to be inserted vertically in the space or gap existing between two successive recipients of a row of recipients.

Figure 13:
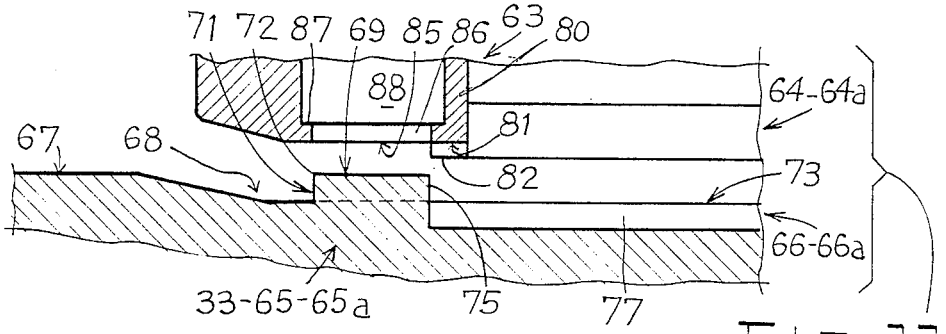
FIG. 13 is a view in elevation of a longitudinal section through the cut-out station along line XIII—XIII of FIG. 12.
Figure 14:
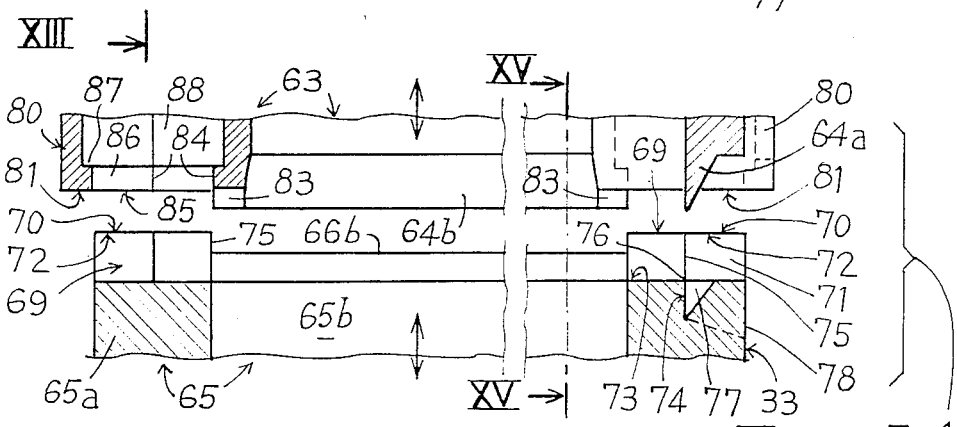
FIG. 14 is a view in elevation of a vertical transverse section through the cut-out station along broken line XIV—XIV of FIG. 12.
Figure 15:
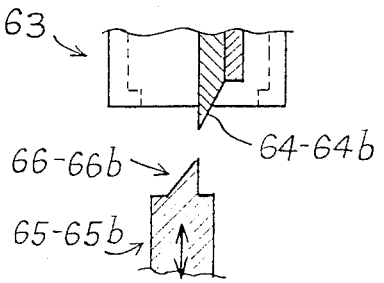
FIG. 15 is a view in elevation of a longitudinal vertical section through the upstream part of the cut-out station along line XV—XV of FIG. 14.

As may be seen in particular in FIGS. 13 and 14, the punches 69 provided at the upstream end of the cut-out station 15 and, more precisely, the lower longitudinal blades 66a are adapted to be covered by upper dies 80 which have a shape corresponding to that of the punches 69 and which form part of the upper cutting tool 63 and which are fast and connected to the upper longitudinal and transverse blades 64a and 64b respectively, these blades 64a and 64b projecting towards the bottom of the lower face 81 of the cutting dies 80 by a distance equal to the cutting stroke of the upper blades 64a, 64b. In order to allow a precise connection of the oblique or concave cut-outs made by the cooperation of the punches 69 and dies 80 with the straight cut-outs made by blades 64 and 66, the lower face 81 of each die comprises on the side adjacent the upper blades 64a, 64b a section of cutting blade 82, 83 which is aligned with the corresponding longitudinal upper blade 64a or transverse upper blade 64b and which cooperates with the lower longitudinal cutting blade 66a or transverse blade 66b in the vicinity of the corresponding vertical edge 75 of the punch 69. To the vertical edges 75 of the punch 69 correspond the inner vertical edges 84 of the die 80 and to the horizontal cutting edges 72 of the punch 69 correspond the inner horizontal cutting edges 85 of said die 80. The cut-out cavity 86 of the die 80, cavity defined by vertical walls of low height less than the cut-out stroke and passing via the cutting edges 85 and joining the vertical edges 84, enlarges laterally by a shoulder 87 of small width to become a tubular guiding cavity 88 for the scrap which may then be recovered without difficulty.

In certain cases, particularly when the zone to be cut out between the incurved, rounded or oblique edge parts of several recipients grouped together and having contiguous rectilinear edge parts, is wider than the supporting and guiding rail 33, it is advantageous to provide the punches 69 of the lower cutting tool 65 not on the fixed part 65*a*, i.e. on the rails 33 (cf. FIGS. 12 to 14) of said lower tool 65, but on the mobile transverse part 65*b* of this tool 65. In this case, the supporting and guiding rails 33 are interrupted at the transverse part 65*b* of the lower cutting tool 65, this transverse part 65*b* then extending over the whole width of the installation. It is advantageous if the horizontal flat upper face 73 of each section of rail acting as fixed longitudinal part 65*a* of the lower cutting tool 65 and comprising the longitudinal cutting blade 66*a*, is located at a level slightly lower than that of the flat upper face 67 of the corresponding rail 33 disposed upstream of the mobile transverse part 6*b* of the lower cutting edge 65. The longitudinal lower cutting blades 66*a* are made in the same manner as those of the example described with reference to FIGS. 12 to 15 and do not need to be described in greater detail, the same references designating the same members or elements. The transverse part 65*b*, mobile perpendicularly to the path of advance of the thermoplastics web 4 is here constituted not by a comb 79 with wide teeth guided between the rails 33, but by a transverse bar which is composed, on the one hand, of a plurality of cylindrical or parallelepipedic vertical bodies 89 disposed so that their axes are located in the vertical planes of the longitudinal cutting blades 66*a* and, on the other hand, of transverse connecting partitions 90 of which each rigidly connects two adjacent vertical bodies 89 and presents a width enabling it to be inserted in the space or gap existing between two successive recipients of a row of recipients. The transverse section of the cylindrical or parallelepipedic vertical bodies 89 is adapted to the shape of the space defined by the curved lateral wall parts of a plurality of recipients grouped together, particularly four adjacent recipients grouped together, of which each is adjacent the other recipients of the group.

The upper face 91 of the mobile transverse bar 65*b* is provided, at each of the vertical bodies 89, with a punch 69 of which the lateral walls 71 are slightly recessed with respect to the lateral faces of the vertical bodies 89 of which the dihedral vertical face parts 92 are guided vertically in guiding grooves 93 provided in the corresponding ends of the sections of rails 33 and the longitudinal fixed parts 65*a* of the lower cutting tool 65. The height of the punches 69 is slightly greater than the cutting stroke of the cutting tools 63 and 65. In the alignment of the longitudinal or transverse vertical planes passing through the vertical axis and two vertical edges 75 of the punch 69 are provided the vertical faces of the sections of longitudinal cutting blade 95 and the vertical faces 96 of the transverse cutting blades 66*b*. In the present case, the sections of blade 95 and the transverse blades 66*b* are constituted by the vertical faces of the V-grooves, but they may also be constituted by the vertical faces of V-sectioned ribs. The vertical faces of the sections of blade 95 are obviously in alignment with the longitudinal vertical planes of the fixed lower blades 65*a*.

Figure 17:
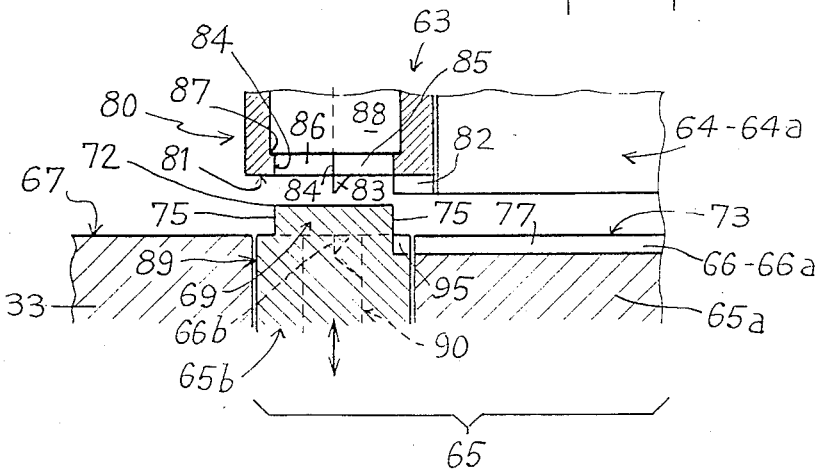
FIG. 17 is a view in elevation of a vertical longitudinal section through the cut-out station along line XVII—XVII of FIG. 16.

The structure of the upper cutting tool 63 is virtually identical to that of the example described previously with reference to FIGS. 12 to 15, and it is therefore unnecessary to describe it in detail with reference to FIG. 17.

Figure 12:
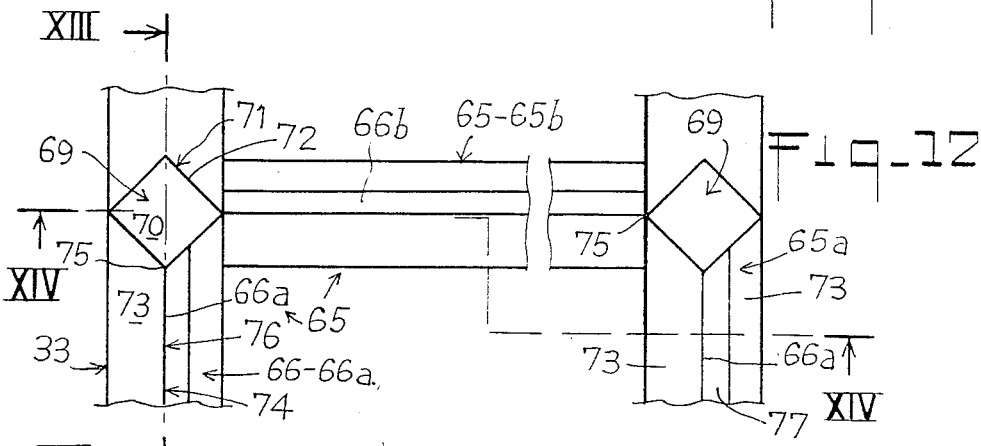
FIG. 12 is a plan view of the lower part of a first embodiment of the cut-out station.
Figure 16:
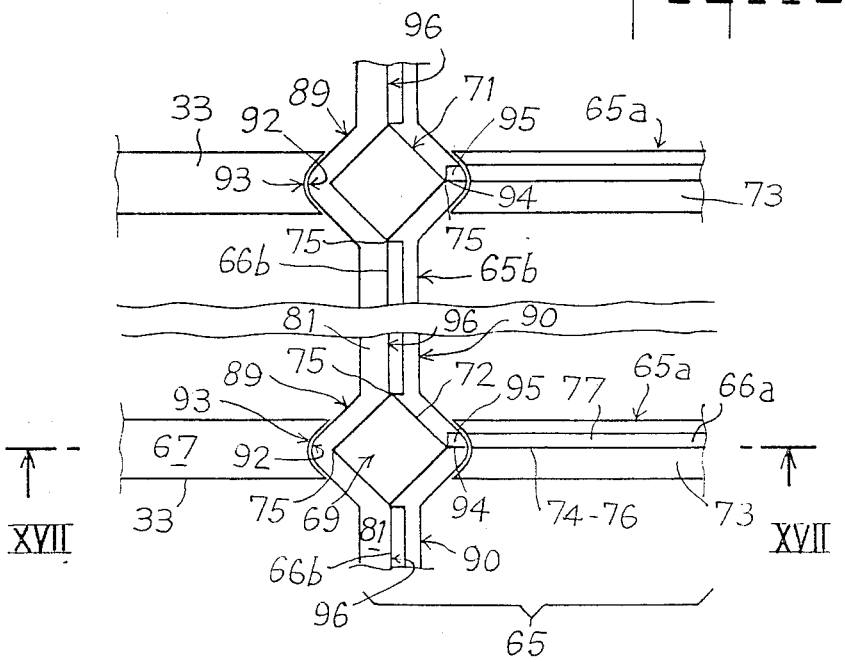
FIG. 16 is a plan view of the lower part of a second embodiment of the cut-out station.

As may be clearly seen in FIGS. 12 and 16, the cutting tools 63 and 65 are arranged so that they cut recipients of which the edges are inscribed in an octogon having two sides parallel to the direction of advance of the recipients, i.e. to the rails 33, two other transverse parallel sides perpendicular to said rails and four oblique sides determined by the edges 72 of two adjacent punches 69, edges converging towards the vertical edge 75 adjacent the transverse cutting blade 66*b* disposed between the two adjacent punches 69. Of course, the cut-outs may also be rounded, instead of being oblique.

As the transverse cutting members are disposed upstream of the longitudinal cutting members, there are cut, on the one hand, from each recipient forming part of the row of recipients located upstream, i.e. at the inlet, of the cutting station 15, that downstream end edge part comprising a transverse part and two oblique lateral parts converging downstream and, on the other hand, from each recipient forming part of the row of recipients engaged in the cut-out station 15, both the two longitudinal edge parts and the upstream end edge part comprising the same transverse part as the adjacent recipient upstream and two oblique lateral parts converging upstream.

The installation 1 also comprises an evacuation station 16 comprising, in addition to the supporting and guiding rails 33, an endless conveyor belt 97 of which the upper side serves as mobile support for the bottom of the recipients cut out individually or in groups and leaving the cut-out station 15. Whilst the recipients 5 rest on the conveyor belt 97, the rails 33 no longer perform their function of support, but they resume it downstream of said belt 97.

As mentioned previously, the installation 1 also comprises means for advancing step by step the recipient-forming web 4 and covering web 12, such as lateral endless chains provided with gripping elements, control means for step-by-step advance of said webs 4 and 12, control means such as jacks 98 for the mobile members provided in the forming station 7, filling station 9, sealing station 13, lateral compression station 14, cut-out station 15 and evacuation station 16.

The installation described hereinbefore makes it possible to carry out a process for packaging a liquid or pasty product and possibly containing a certain quantity of foam or air bubbles, process comprising thermoforming, filling, sealing and cutting out of recipients made of thermoplastics material. To enable the recipients 5, 5*a*, 5*b*, 5*c*, 5*d* to advance in the direction of the downstream end of the installation, the path of advance of said recipients 5, 5*a*, 5*b*, 5*c*, 5*d* in the forming station 7, the sealing station 13, possibly the lateral compression station 14 and the cut-out station 15, is cleared by lowering in the direction perpendicular to the plane of advance of the thermoplastics web 4 and by a height at least equal to that of the recipients: the mobile front part 26*b* of the moulding unit 26; the mobile part or supporting comb 40*b* of the lower sealing support 40; possibly the front plate 62; and the mobile transverse part 65*b* of the lower cutting tool 65. This modus operandi lends itself more particularly to the thermoforming of the recipients 5 row after row. The recipients 5 (it being specified that the recipients are designated by references 5*a*, 5*b*, 5*c*, 5*d* only in the case of their occupying a determined position in the filling station 9, sealing station 13 and lateral compression station 14) and the path of the thermoplastics web 4 through the installation 1 may be slightly inclined with respect to the horizontal downwardly and from upstream towards downstream of said installation with a view to promoting filling of the recipients 5, the angle of inclination preferably not exceeding about thirty degrees. It is then advantageous to fill each recipient in two steps which, in time, are separated by a step of advance of said recipients. During the first step which corresponds to the position of the recipient 5*a* beneath the nozzle 34, the major part of the volume of said recipient 5*a* is filled rapidly, i.e. at high speed, with product. This is a rough filling up to level 43 which is still at a short distance beneath the downstream edge part of the inclined recipient 5*a*. After the advance by one step, the recipient will be in the position 5*b* in which it is already partially engaged in the sealing station 13. As this recipient 5*b* enters the sealing station 13, its opening and its edge, i.e. the thermoplastics web 4, is covered with the covering web 12. It will be noted in the drawing that, whilst the recipient 5*b* is partially engaged in the sealing station 13, the preceding row of recipients 5*c* downstream is also located in said station 13. The covering web 12 is then joined to the recipient-forming web 4 along longitudinal sealing zones 36 at least along the edges of said webs 4 and 12 over a length greater than a step of advance E of the recipients 5 and disposed to overlap the two recipients or rows of successive recipients 5*b*, 5*c* engaged in the sealing station 13. After the longitudinal sealing, the filling of the recipient 5*b* through the reduced opening 42 is then completed up to a level 44 which is located above the downstream edge part of the recipient 5*b* but beneath the upper end of the longitudinal sealing zones 36, this complementary filling with the aid of the nozzle 35 being effected at low speed. The recipients are then advanced further.

The transverse seal 51 may then be effected on the downstream edge part of the recipient 5*c* and at the same time on the upstream edge part of the preceding recipient 5*d* downstream which has just left the sealing station 13. This modus operandi already enables recipients to be manufactured which are almost completely filled and which include only a small quantity of air. However, if, before effecting transverse sealing, the walls or lateral sides of the recipient 5*d* which has already left the sealing station 13 is compressed more or less strongly to produce a reduction in the inner volume of the recipient 5*d*, so that this slightly reduced volume is entirely filled with the product, the air, then the air bubbles (or the foam of product) and finally a certain quantity of excess product, may be driven out or delivered through the slot 53 between the adjacent transverse edges of recipients 5*c* and 5*d* and the covering web 12, from the recipient 5*d* towards the upstream recipient 5*c* and, possibly, from recipient 5*c* towards upstream recipient 5*b*, with the result that, it the transverse seal 51 is then effected whilst the lateral compression is maintained applied on the lateral walls of the recipients 5*d*, this latter recipient is surely entirely filled with the product and contains virtually no residual air. It has proved that the slots 53 may be successfully used for breaking or bursting all the large air bubbles in the foam of product, of which bubbles the dimensions are greater than the fairly small width of the slot 53.

Of course, to avoid a substantial depression or internal vacuum in the recipients which have been filled as far as possible, the degree of compression is maintained at a value just sufficient to drive out or deliver the small quantity of air existing in the recipient. Afterwards, the filled and sealed recipients are cut out in the cut-out station 15 and immediately evacuated towards the wrapping stations.

The invention is not limited to the embodiments described hereinbefore, but covers all the features as defined by the accompanying claims. For example, the inclined downstream end of the rails 33 may serve as wrapping station. The rails 33 may be interrupted over a short distance at the mobile part 40*b* of the lower sealing support. In this case, this mobile part 40*b* may be constituted by a transverse bar moving vertically without clearance in the gap left free by the rails 33 at their interruption. The punches 69 and the corresponding dies 80 and/or the upper and lower transverse blades 64*b*, 66*b* may in certain cases be disposed downstream of the longitudinal blades 64*a* and 66*a*.

What is claimed is:

1. A process for packaging a product comprising the steps of:

longitudinally advancing a thermoplastic base web downstream, step by step, through a plurality of work stations;

heating successive zones of the base web to soften the base web;

forming a row of receptacles in each successive zone of the base web in a forming station having a mobile transverse part;

filling a row of receptacles with a product through openings in the receptacles;

covering the openings of filled receptacles with a covering web;

sealing the covering web to the base web in a sealing station including a lower sealing support having a mobile transverse part;

cutting out the filled and sealed receptacles from the base and covering webs in a cutting station including a lower cutting tool having a mobile transverse part;

supporting the receptacles and corresponding zones of the base web between the different work stations by support and guide rails extending parallel to the direction of advance of the base web and the receptacles;

lowering the mobile parts of the forming station, the sealing station, and the cutting station to clear the path of advance of the receptacles;

using sections of the support and guide rails in the sealing station as fixed parts of the lower sealing support; and using other sections of the support and guide rails in the cutting station as fixed parts of the lower cutting tool, and to support the cut-out receptacles.

2. A process according to claim 1 wherein the sealing step includes the steps of:

establishing a longitudinal seal between the base and covering webs, the longitudinal seal at least partially overlapping two successive rows of receptacles; and establishing a transverse seal between the base and covering webs.

3. A process according to claim 2 wherein:

the covering step includes the steps of partially covering each row of receptacles, and then covering the remainder of the row of receptacles;

the filling step includes the steps of filling a major part of the volume of each row of receptacles at a high speed, advancing the row of receptacles by one step, and then filling the remainder of the volume of the row of receptacles at a low speed; and the remainder of the volume of the row of receptacles is filled after the row of receptacles is partially covered and a longitudinal seal is developed between the cover and the base webs extending partially along the row of receptacles.

4. A process according to claim 3 wherein the sealing step further includes the steps of:

advancing each row of receptacles one step after a longitudinal seal is established at least partially overlapping the row of receptacles; and then establishing a transverse seal between the base and covering webs, immediately adjacent the row of receptacles.

5. A process according to claim 4 wherein the receptacles are downwardly inclined in the downstream direction, during at least the filling and sealing steps.

6. A process according to claim 2 wherein:

the sealing step includes the step of forming a slot between each receptacle and a receptacle upstream thereof;

the process further comprises the steps of (i) compressing the receptacles to reduce the volume thereof so that the receptacles become completely filled with the product, and (ii) conducting any excess product from a selected receptacle, through a slot formed between the selected receptacle and a receptacle upstream thereof, into said upstream receptacle; and the sealing step further includes the step of closing the slots between the receptacle.

7. A process according to claim 6 wherein the step of conducting excess product includes the step of conducting foam from the selected receptacle, through the slot formed between said selected receptacle and said upstream receptacle, into the upstream receptacle.

8. A process according to claim 1 further comprising the steps of:

compressing each receptacle after it has been filled and before the sealing step is completed to reduce the volume of the receptacle and to force any excess product out therefrom; and delivering excess product from a receptacle to a receptacle upstream thereof;

each receptacle being compressed as the sealing step is completed to produce a slight depression in the receptacle.

9. A process according to claim 8 wherein:

each receptacle includes a plurality of deformable parts;

the compressing step includes the steps of (i) compressing a first deformable part of each receptacle, and (ii) maintaining the other deformable parts of the receptacle undeformed;

the sealing step includes the step of forming a slot between each receptacle and a receptacle upstream thereof;

the delivering step includes the step of conducting excess product from a receptacle to a receptacle upstream thereof through the slot therebetween; and the sealing step further includes the step of sealing the slots between upstream and downstream receptacles while compressing the downstream receptacles.

10. A process according to claim 8 wherein the compressing step includes the steps of:

applying a force to the receptacles; and adjusting the magnitude of the force in response to the weight of at least on receptacle cut out from the base and covering webs.

11. A process according to claim 1 wherein the cutting step includes the steps of:

cutting a downstream edge of each receptacle;

then advancing the receptacle by one step; and then cutting an upstream edge of the receptacle.

12. A process according to claim 2 wherein at least one of the parameters, selected from the group consisting of pressure and temperature, is different when the transverse seal is established than when the longitudinal seal is established.

13. A process for packaging a product comprising the steps of:

longitudinal advancing a thermoplastic web downstream through a plurality of work stations;

forming receptacles in the web;

filling the receptacles with a product;

closing the receptacles;

cutting out the receptacles;

supporting the receptacles between the work stations by support and guide rails extending parallel to the direction of advance of the thermoplastic web and the receptacles;

supporting the receptacles on first sections of the support and guide rails during the closing step; and supporting the receptacles on second sections of the support and guide rails during the cutting step.

* * * * *